United States Patent [19]

Piano

[11] Patent Number: 4,875,326

[45] Date of Patent: Oct. 24, 1989

[54] SOFT CHEWING GUM WRAPPING MACHINE AND METHOD

[75] Inventor: Anthony P. Piano, Sparta, N.J.

[73] Assignee: Warner-Lambert Company, Morris Plains, N.J.

[21] Appl. No.: 169,521

[22] Filed: Mar. 17, 1988

[51] Int. Cl.[4] ..... B65B 11/00; B65B 35/28; B65B 47/04

[52] U.S. Cl. ..... 53/435; 53/464; 53/513; 53/541; 53/579

[58] Field of Search ..... 53/435, 453, 464, 513, 53/514, 519, 520, 579, 541, 559

[56] References Cited

U.S. PATENT DOCUMENTS

| | | | |
|---|---|---|---|
| 2,010,997 | 8/1935 | Jurgensen | 53/520 X |
| 2,664,833 | 1/1954 | Armstrong et al. | 53/514 |
| 3,273,300 | 9/1966 | Watrous et al. | 53/435 |
| 3,521,422 | 7/1970 | Tabor | 53/453 X |
| 3,775,932 | 12/1973 | Jeney | 53/453 X |
| 3,871,155 | 3/1975 | Blaser | 53/559 X |
| 4,352,265 | 10/1982 | Hänsel et al. | 53/541 |
| 4,428,177 | 1/1984 | Focke et al. | 53/579 X |
| 4,558,557 | 12/1985 | Kuehfuss | 53/520 X |
| 4,633,651 | 1/1987 | Edmunds | 53/453 X |

*Primary Examiner*—Robert L. Spruill
*Assistant Examiner*—Beth Bianca
*Attorney, Agent, or Firm*—Daniel A. Scola, Jr.; Charles A. Gaglia, Jr.

[57] ABSTRACT

An apparatus for wrapping soft chewing gum comprises a turret having means to cut the gum into relatively thin rectangular shaped pieces. Operatively associated with the turret are means to hold the shaped pieces of gum thereon for transport to a position where each individually shaped piece is placed into a nest on a wrapping tray with a wrapper located therebetween. During placement, a flat side of the shaped piece of gum is urged against the flat bottom of the nest. The apparatus further comprises means to complete wrapping the wrapper around the piece of gum.

14 Claims, 3 Drawing Sheets

SOFT CHEWING GUM WRAPPING MACHINE AND METHOD

BACKGROUND OF THE INVENTION

This invention relates generally to machines for wrapping articles. More particularly, this invention relates to a machine for cutting and wrapping soft or uncured gum. The present invention is particularly, but not exclusively, useful for wrapping sticks of soft or uncured gum which are rectangular shaped and relatively thin.

DISCUSSION OF THE PRIOR ART

Chewing gums are merchandised in various forms. The more common and popular forms are the "stick" gums, the "pillow" shaped gums and the hard confectionary coated "tablets" and "gum balls." Additionally, novelty chewing gums are marketed in a variety of forms depending upon the perceived desires of the purchasing public. As should be expected, each form of gum presents its own unique packaging problems.

While the confectionary coated gums are typically boxed or bagged in bulk, the nature of "stick" gums and "pillow" shaped gums require they be individually wrapped.

If the gum is cured before wrapping, it develops some rigidity which helps in the wrapping process. Indeed, the wrapping of cured "stick" gum is typically accomplished by exploiting the rigidity of cured bum to effectively use the "stick" as a die. More specifically, in this process the edge of a cured, and therefore rigid, piece of "stick" gum is urged against wrapping paper to fold the wrapping paper around the gum. This works fine if the gum is rigid. On the other hand, if the gum is soft or uncured the gum is inherently floppy and cannot be used as a die. As between the "stick" gums and the "pillow" shaped gums, the latter are relatively bulky and, consequently, more rigid. Thus, even when the gum is soft, the "pillow" shaped gums can be fairly easily wrapped. This is not so for "stick" gums. Accordingly, the manufacturing of soft gums has been limited generally to the "pillow" form which, as previously implied, presents a more rigid configuration than the "stick" form.

In addition to the problem of actually wrapping a stick of soft gum, there is also the difficulty of transporting the soft gum through the machine during the wrapping process. Because of the floppy nature of a stick of soft gum, there is a need for continuous support during the wrapping process. Using machines which are designed for wrapping sticks of cured gum has several shortcomings if they are used to wrap sticks of soft gum. Specifically, they neither present the sticks of gum for wrapping, nor transport them through the wrapping machine in a manner which is compatible with the limp and floppy nature of soft gum.

A commercially effective solution to these problems is needed because there is a perceived consumer demand for soft "stick" gum. The configuration of "stick" gum is convenient and the appeal of soft gum is well established.

The present invention recognizes that soft gum can be cut into "sticks" and properly supported during the wrapping process. Specifically, the present invention recognizes that a stick of soft gum can be held and oriented by a machine in a manner which will obviate the difficulties presented by the flaccid nature of uncured soft gum.

In light of the above, it is an object of the present invention to provide a gum wrapping machine which will rigidly support a stick of soft gum during the wrapping process. Another object of the present invention is to present a soft stick of gum for wrapping in a manner which will obviate the flaccidity of the gum. Still another object of the present invention is to provide a gum wrapping machine which is cost effective and easy to operate.

SUMMARY OF THE INVENTION

A preferred embodiment of the novel soft chewing gum wrapping machine of the present invention includes a turret for cutting the gum into relatively thin rectangular shaped pieces, i.e. sticks of gum. The turret also conveys these shaped pieces to a position where they can be individually placed into nests on a wrapping tray. More specifically, the turret comprises a plurality of cutting cavities on its periphery in which the individual "sticks" are held by suction for conveyance to a wrapping position after they have been cut. Rotation of the turret cuts sticks of gum from a slab of gum and takes each stick of gum to the wrapping position where it is released from the turret and urged into a nest on the wrapping tray. A wrapper, of foil or waxed paper, is positioned over each nest so that when the gum "stick" is urged into the next, the wrapper is located therebetween for initiation of the wrapping process. Importantly, as the "stick" is urged into the next, a flat side, not an edge, of the gum "stick" is presented to the next.

In an alternate embodiment of the present invention, a reversing turret is incorporated between the turret and the wrapping tray. With this alternate embodiment, each stick of gum is transferred to the reversing turret before being urged into a particular nest on the wrapping tray. The reversing turret in the alternate embodiment is similar to the turret of the preferred embodiment in that it holds gum "sticks" thereon by suction. Also, its operation is similar to the turret of the preferred embodiment insofar as placement of each gum "stick" into a nest is concerned.

With the reversing turret incorporated, operation of the wrapping machine provides a linear manufacturing process between the turret and the wrapping tray. Without the reversing turret, the manufacturing operation proceeds onto a return line.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENTS OF THE PRESENT INVENTION

Figure 1:
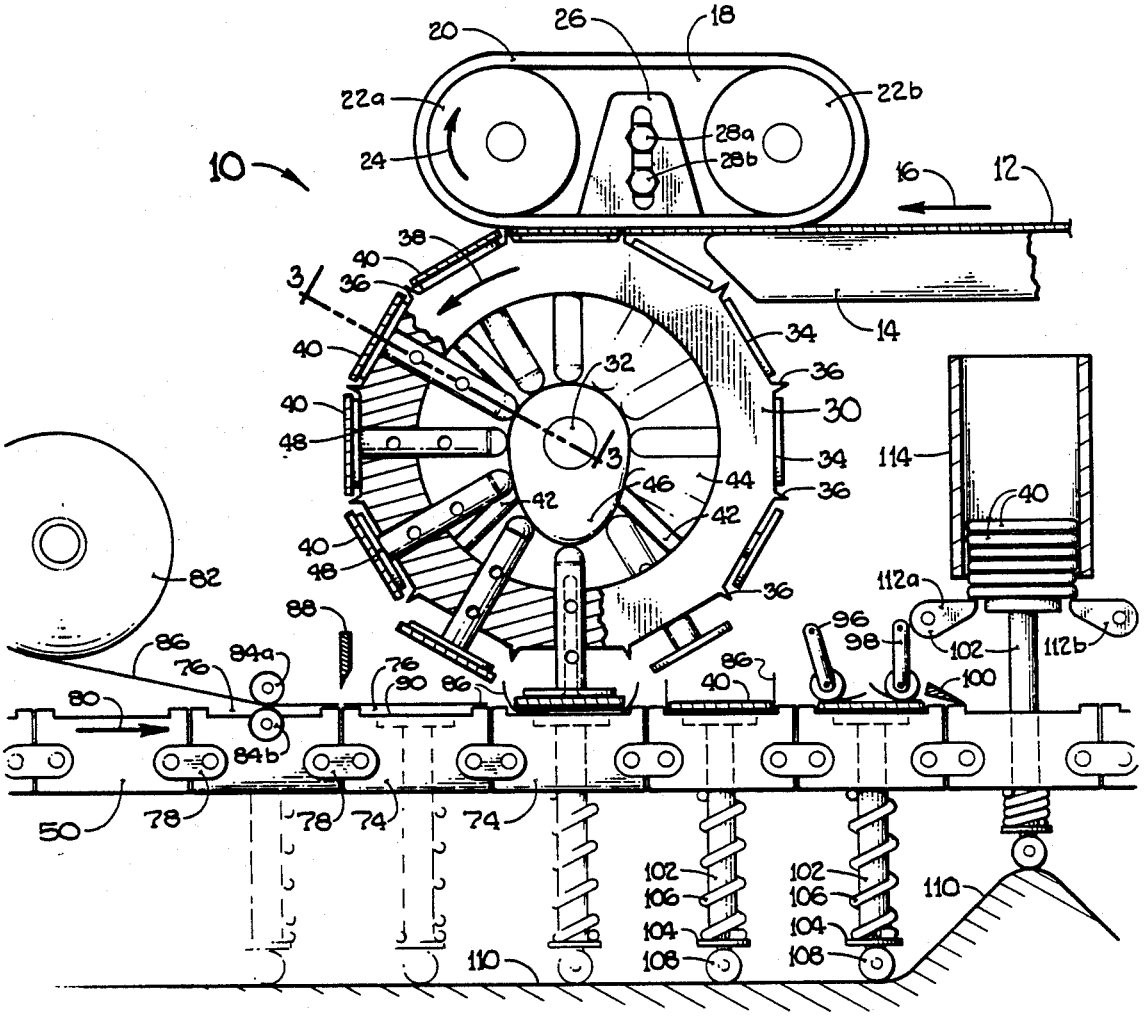
FIG. 1 is a schematic of the preferred embodiment of the present invention.

Referring initially to FIG. 1, the preferred embodiment of the novel soft chewing gum wrapping machine is shown and generally designated 10. As shown in FIG. 1, an extruded, sized slab 12 of chewing gum is fed into machine 10 by a conveyor 14 in the direction indicated by arrow 16. Although slab 12 may be dimensioned in length and width as desired by the operator, typically, slab 12 is dimensioned in its thickness to conform with market expectations for "stick" gum.

The feeding of gum slab 12 into machine 10 is facilitated by feed and pressure assembly 18 which includes a belt 20 that is operatively engaged with drive rollers 22*a* and 22*b*. Rotation of drive rollers 22*a* and 22*b* in the direction indicated by arrow 24 causes belt 20 to draw slab 12 toward machine 10 in the direction of arrow 16. Assembly 18 also includes an adjustable pressure block 26 which, in accordance with the tightened location of bolts 28*a* and 28*b* on block 26, puts pressure on belt 20 to urge slab 12 against turret 30.

As can be appreciated by reference to FIG. 1, turret 30 is a generally cylindrical shaped body which is operatively connected with a drive motor (not shown) for rotation about the axis of a drive shaft 32. On the surface of turret 30 are located a plurality of cutting cavities 34 which are separated from each other by series of knives 36 that project radially outward from the surface of turret 30. In accordance with the present invention, rotation of turret 30 about drive shaft 32 in the direction of arrow 38 brings knives 36 into cutting contact with slab 12 to divide slab 12 into individual gum sticks 40.

Still referring to FIG. 1, it will be seen that turret 30 is structurally separated from drive shaft 32 by a series of braces 42 to form a vacuum chamber 44 therebetween. For the purposes of the present invention, any means well known in the art may be used in cooperation with chamber 44 to create a partial vacuum therein. Also, it is seen that a stationary cam 46 is operably mounted in association with chamber 44 for a purpose to be subsequently disclosed. For each cutting cavity 34, a stick holder 48 is provided which functions in cooperation with turret 30, cam 46 and the operation of vacuum chamber 44 to carry gum sticks 40 from a cutting position associated with assembly 18 to a wrapping position associated with wrapping tray 50.

Figure 2:
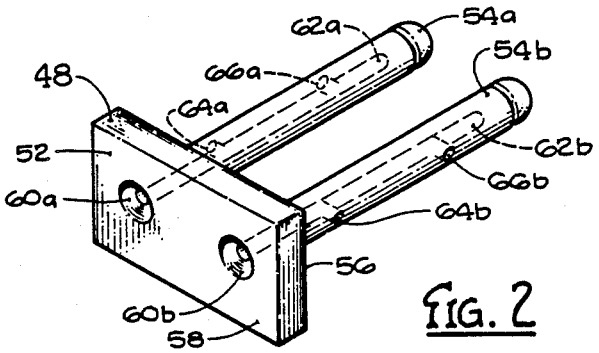
FIG. 2 is a perspective view of the stick holder of the present invention.

The structure for stick holder 48 will perhaps be best appreciated by reference to FIG. 2 in which it can be seen that holder 48 comprises a base 52 having a pair of stems 54*a* and 54*b* extending from the rear side 56 of base 52. The front side 58 of stick holder 48 is formed with a pair of recesses 60*a* and 60*b* which are operative extensions of respective air channels 62*a* and 62*b*. As shown in FIG. 2, air channels 62*a* and 62*b* respectively extend internally along the longitudinal axes of stems 54*a* and 54*b*. Also shown in FIG. 2 are relief ports 64*a* and 64*b* and suction ports 66*a* and 66*b* which are respectively associated in operative communication with air channels 62*a* and 62*b*.

Figure 3A:
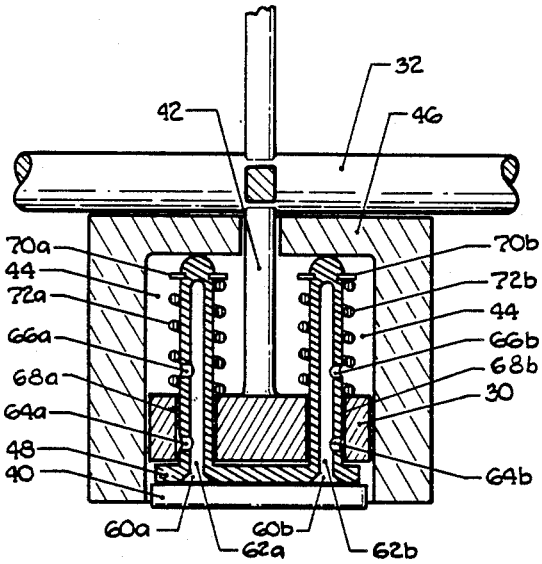
FIG. 3A is a cross-sectional view of the present invention as seen along the line 3—3 in FIG. 1 with portions broken away for clarity.
Figure 3B:
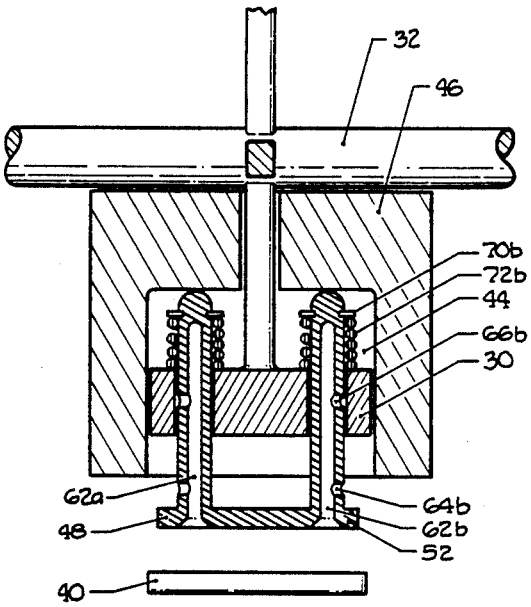
FIG. 3B is a cross-sectional view of the part of the present invention seen in FIG. 3A with component elements in a different configuration.

The cooperation of structure between stick holder 48, turret 30 and cam 46 will be best appreciated by referring to FIGS. 3A and 3B. In FIG. 3A, it will be seen that stems 54*a* and 54*b* are respectively slidably disposed in bores 68*a* and 68*b* of turret 30. Also, it is to be understood that holder 48 is provided with two stems 54*a* and 54*b*, as shown and disclosed above, to provide stability for holder 48 during operation of machine 10. Further, each stem 54*a* and 54*b* is respectively provided with a retainer ring 70*a* and 70*b*. Springs 72*a* and 72*b* are disposed around stems 54*a* and 54*b* and positioned between retainer rings 70*a*, 70*b* and turret 30. As so disposed, springs 72*a* and 72*b* are biased to urge stems 54*a* and 54*b* of stick holder 48 against cam 46. Thus, depending on the distance between cam 46 and turret 30, base 52 and holder 48 will either rest against turret 30, as shown in FIG. 3A, or be pushed away from turret 30, as shown in FIG. 3B. As will be appreciated, the actions of springs 72*a* and 72*b* urge stick holder 48 into the position shown in FIG. 3A whenever the distance between cam 46 and turret 30 will permit.

Figure 4:
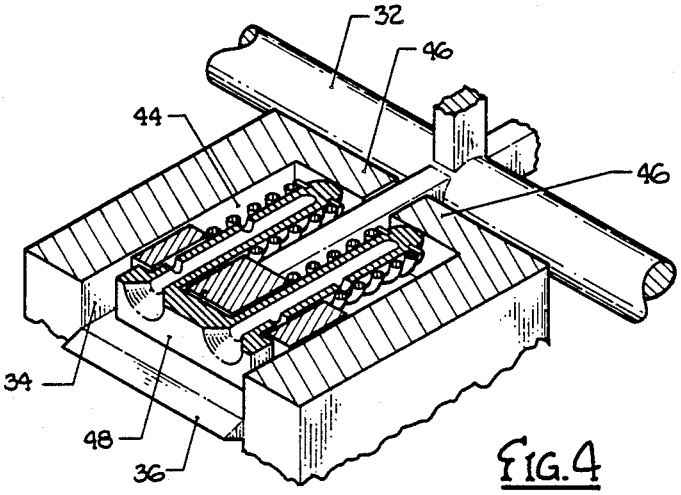
FIG. 4 is a perspective view of the part of the present invention seen in FIG. 3A.

FIG. 4 provides another perspective of the cooperation between holder 48, turret 30 and cam 46. Together with FIGS. 3A and 3B, FIG. 4 shows that holder 48 is intended for reciprocal movement relative to turret 30. As will be more clearly understood subsequently, this reciprocal action is necessary for holding the gum sticks on turret 30 and for the purpose of ejecting gum sticks 40 from cutting cavity 34.

Returning now to FIG. 1, it will be seen that in accordance with the intentions of the present invention, gum sticks 40 are to be held onto holder 48 only until they are presented to wrapping tray 50. The sticks 40 are then released from holder 48. This happens because apparatus (not shown) is used to draw a partial vacuum in chamber 44. Accordingly, when cam 46 permits springs 72*a* and 72*b* to urge holder 48 into the position as shown in FIG. 3A, suction ports 66*a* and 66*b* are is fluid communication with chamber 44. This communication is affected through air channels 62*a* and 62*b* on base 52 of holder 48. The result is that the ambient air pressure forces stick 40 against base 52 to hold the stick 40 on holder 48. It is to be noted that while suction ports 66*a* and 66*b* are in communication with chamber 44, relief ports 64*a* 64*b* are effectively blocked by turret 30. On the other hand, when cam 46 urges against stems 54*a* and 54*b* to depress springs 72*a* and 72*b*, suction ports 66*a* and 66*b* are effectively blocked by turret 30 and relief ports 64*a* and 64*b* are exposed for direct communication with the ambient air. This negates the sucking action at recesses 60*a* and 60*b* and allows stick 40 to be released from holder 48.

Further reference to FIG. 1 shows that turret 30 is intended to cooperate with operation of wrapping tray 50. As shown, wrapping tray 50 comprises a series of blocks 74 which are each formed with a nest 76. Each 74 is connected to an adjacent block 74 by means of linked connectors 78 in a manner well known in the pertinent art. As intended for the present invention wrapping tray 50 will function similarly to the well known conveyor belt and progress in a direction relative to turret 30 as indicated by arrow 80.

Figure 6:
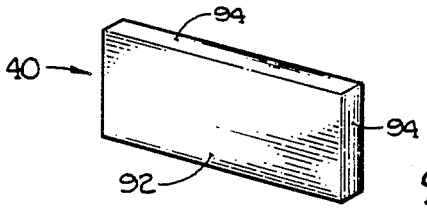
FIG. 6 is a perspective view of a stick of gum.

Disposed in operative relationship to wrapping tray so is a roll 82 or wrapping paper 86. It is to be understood that several wrapping materials 86 may be used within the spirit of the present invention. For example, roll 82 may be of waxed paper or foil. Regardless, drive rollers 84*a* and 84*b* draw wrapping 86 from roll 82 and lay wrapping 86 over next 76 of block 74. In coordination with the movement of wrapping tray 50, a knife means 88 cuts wrapping 86 into appropriate sized sections. Subsequently, when next 76 is properly positioned with respect to turret 30, a holder 48 urges a stick 40 into the nest 76. Importantly, each nest 76 has a flat bottom 90. Further, and equally as important, a flat side 92 of gum stick 40 is urged into nest 76. At this point, cross reference between FIG. 1 and FIG. 6 will show that presenting a flat side 92 or stick 40 for insertion into next 76, rather than using an edge 94 of stick 40, greatly obviates any required rigidity for stick 40. Stated differently, the rigidity of stick 40 is rendered essentially immaterial.

Further reference to FIG. 1 shows that as gum stick 40 is inserted into next 76, wrapping 86 is caused to fold up around edges 94 of stick 40. Also, it can be seen that a back flap kicker 96 and a front flap kicker 98, as well as a plow 100, are each operatively associated with wrapping tray 50 to complete the wrapping process. For purposes of the present invention any back flap kicker 96, front flap kicker 98 and plow 100, well known in the art, can be used.

FIG. 1 also shows that an extracting rod 102 is associated with each block 74. More specifically, each extracting rod 102 has an attached retaining ring 104 with a spring 106 disposed around extracting rod 102 and positioned between block 74 and retaining ring 104. A roller 108, or other gliding means, is associated with extracting rod 102 and positioned with respect thereto to ride along a cam surface 110. It will be appreciated that spring 106 urges roller 108 of extracting rod 102 into contact with cam surface 110. Accordingly, the contour of cam surface 110 will be set to appropriately depress spring 106 and cause extracting rod 102 to lift a wrapped stick 40 from next 76 of wrapping tray 50.

As also seen in FIG. 1, when individually wrapped sticks 40 are lifted from wrapping tray 50 by the action of extracting rod 102, each stick 40 is pushed against spring loaded retainers 112*a* and 112*b* which yield to the passage of sticks 40. As will be appreciated by the skilled artisan, once sticks 40 have passed retainers 112*a* and 112*b* the sticks 40 will be held in magazine 114 until a predetermined number of sticks 40 have been collected for subsequent bundling.

Figure 5:
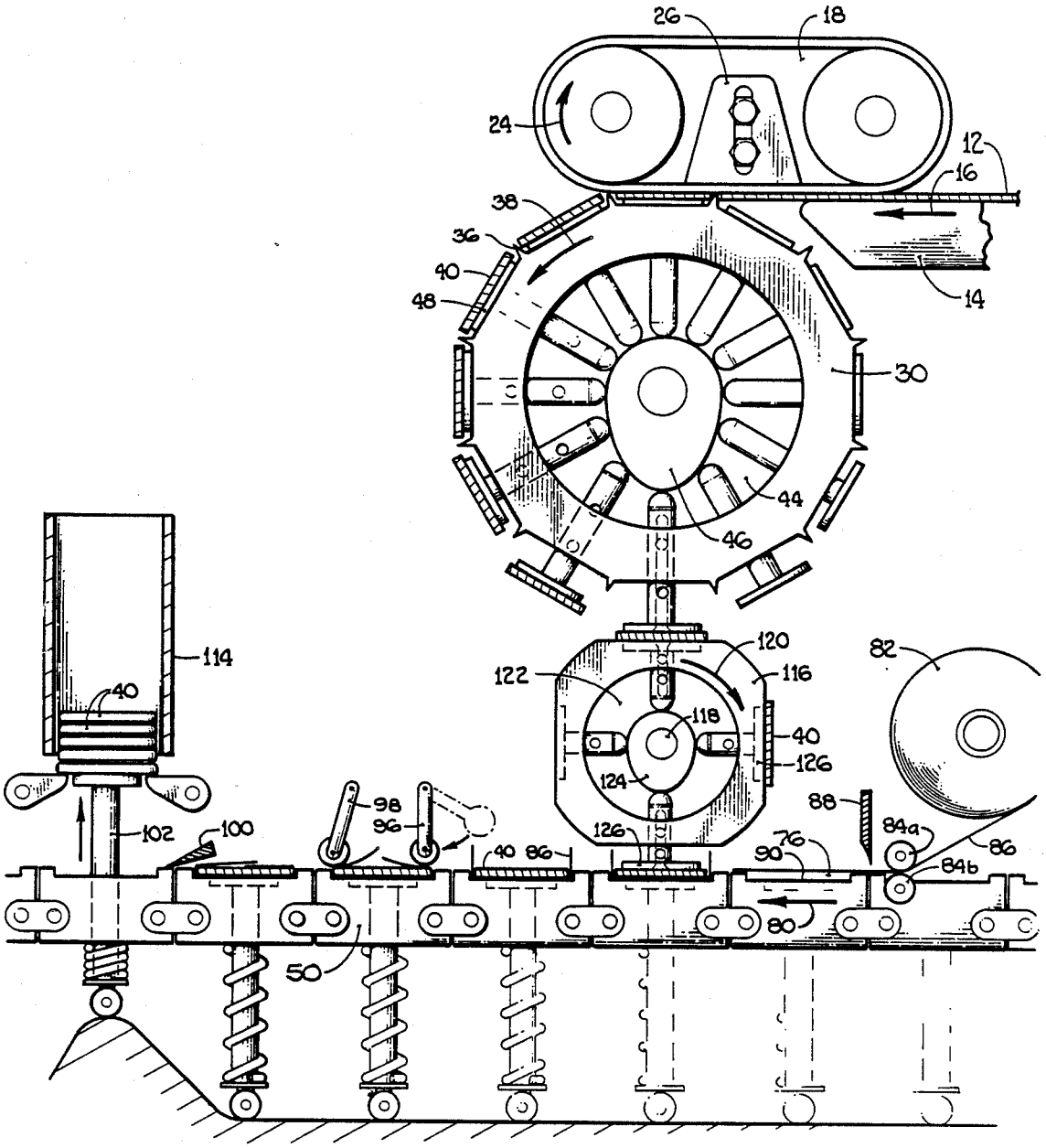
FIG. 5 is a schematic of an alternative embodiment of the present invention.

An alternate embodiment for the present invention is shown in FIG. 5. Specifically, the alternate embodiment is functionally preferable when it is desired to conduct the wrapping operation to be accomplished by machine 10 along a linear assembly line. In other words, the progress of the operation is conducted along a line of operations rather than requiring the doubling back which happens in the operation of the preferred embodiment discussed previously.

In all important respects, the alternate embodiment of the present invention functions substantially in accordance with the disclosure for the preferred embodiment. The difference between the two being essentially the incorporation of a reversing turret 116 for the alternate embodiment. Here also, however, the similarities are substantial. Specifically, reversing turret 116 is driven by a motor (not shown) to rotate about the axis of drive shaft 118 in the direction of arrow 120. Reversing turret 116 is associated with a vacuum chamber 122 and a stationary cam 124 which are substantially similar to the comparable structure associated with turret 30. Further, reversing turret 116 cooperates with a series of stick holders 126 which are similar in structure and cooperation of structure to that disclosed previously for stick holder 48.

As mentioned previously, the cooperation of structure between reversing turret 116, stationary cam 124 and stick holder 126 is similar in all important respect to comparable structure disclosed for the preferred embodiment. However, because turret 30 rotates counter to the rotation of reversing turret 116, a stick 40 can be passed from conveyor 14 to wrapping tray 50 without a resultant reversing direction in the process.

OPERATION

In the operation of the novel soft chewing gum wrapping machine 10, a slab 12 of gum is drawn into machine 10 by the action of feed and pressure assembly 18. Pressure caused by block 26 in its action against belt 20 presses slab 12 into the cutting cavities 34 of turret 30 to separate slab 12 into individual sticks of gum 40.

Stick holders 48 are operatively associated with turret 30 to hold sticks 40 onto turret 30 during part of the operation and to subsequently release sticks 40 into wrapping tray 50. The holding function is made possible by stems 54 which project from base 52 and are slidably disposed through turret 30 to extended into vacuum chamber 44. When stems 54*a* and 54*b* are fully extended into vacuum chamber 44, fluid communication is established from chamber 44 through air channels 62*a* and 62*b* to create a sucking action at the recesses 60*a* and 60*b* located on base 52 of stick holder 48. So long as vacuum chamber 44 is in communication with air channels 62*a* and 62*b*, the partial vacuum causes individual sticks 40 to be held within cutting cavities 34. During rotation of turret 30 this action continues until such time as cam 46 urges against the stems 54*a* and 54*b* of stick holder 48 to push stick holder 48 out of the cutting cavity 34. With this action, air channels 62*a* and 62*b* are cut off from fluid communication with the interior of vacuum chamber 44. Instead, relief ports 64*a* and 64*b* establish fluid communication between air channels 62*a* and 62*b* and the ambient air. This association with ambient air negates the suction effect created by vacuum chamber 44 and causes stick 40 to be released from base 52 of stick holder 48.

The operation of stick holder 48 with turret 30 will be further appreciated by cross referencing FIGS. 1, 3A and 3B. With reference to these figures, it will be seen that the connection between drive shaft 32 and turret 30 through braces 42 causes drive shaft 32 to rotate turret 30. Also, stick holder 48 rotates with turret 30 because stems 54*a* and 54*b* of holder 48 slidably extend through bores 68*a* and 68*b* of turret 30 and are retained therein by the interaction of base 52 with springs 72*a* and 72*b*.

Stated somewhat differently from above, as each holder 48 is rotated about the axis of drive shaft 32, stems 54*a* and 54*b* are urged against stationary cam 46 by springs 72*a* and 72*b*. Accordingly, depending on the location of holder 48 relative to cam 46, holder 48 will be urged away from the axis of drive shaft 32 by the action of cam 46 while simultaneously being urged toward the axis of drive shaft 32 by the action of springs 72*a* and 72*b*. The result is a reciprocal motion of holder 48 with respect to turret 30 between a first position and a second position that alternatingly establishes fluid communication either between suction ports 66*a* and 66*b* and vacuum chamber 44 (first position), or between relief ports 64*a* and 64*b* and the ambient air (second position). Also, when holder 48 is in the second position, base 52 is lifted from cutting cavity 34. Consequently, when holder 48 is in the first position, base 52 is seated in cutting cavity 34 and fluid communication between air channels 62a and 62b and vacuum chamber 44 establishes a sucking action at recesses 60a and 60b which will hold a stick of gum 40 against base 52. On the other hand, when cam 46 urges holder 48 into the second position, fluid communication between the ambient air and air channels 62a and 62b stops the sucking action at recesses 60a and 60b to release stick 40 from base 52.

In accordance with the operation of the present invention, the rotational position of turret 30 must be coordinated with the location of wrapping tray 50. Specifically, as seen in FIG. 1, as a stick holder 48 is urged out of fluid communication with vacuum chamber 44 to release a stick 40 from stick holder 48, the stick holder 48 needs to be positioned with respect to a nest 76 in block 74 of wrapping tray 50 to allow insertion of stick 40 into the next 76. Additionally, prior to insertion of stick 40 into next 76, a foil or paper wrapping 86 needs to be positioned across next 76. This allows the action of inserting stick 40 into the next 76 to also initiate the wrapping procedure for stick 40. More specifically, as stick 40 is inserted into next 76, the wrapping 86 is caused to fold over edges 94 of stick 40 in a manner as substantially shown in FIG. 1. Since the position of stick holder 48 in the wrapping position has negated the suction effect from vacuum chamber 44, stick 40 is no longer held by stick holder 48 and upon withdrawal of stick holder 48, will remain in the nest 76.

In accordance with the present invention, once a stick 40 has been properly inserted into next 76, wrapping tray 50 proceeds in a manner which will present the next nest 76 in line in the position where the next stick 40 can be inserted therein. This action also takes each nest down the manufacturing line to allow the action of back flap kicker 96, front flap kicker 98 and plow 100 to complete the wrapping process of stick 40. Once stick 40 has been completely wrapped, the action of extracting rod 102, in cooperation with cam surface 110, causes each wrapped stick 40 to be lifted from nest 76 and deposition in a magazine 114 for subsequent packaging or bundling procedures.

In the operation of the embodiment of the present invention shown in FIG. 5, all actions are substantially the same as those previously disclosed for the preferred embodiment. As will be appreciated by the skilled artisan, the main difference between the preferred embodiment and the alternate embodiment resides in the incorporation of a reversing turret 116 for the alternate embodiment. In all respects, the action of reversing turret 116 is the same as that disclosed for turret 30. More specifically, however, incorporation of reversing turret 116 allows the progress of individual sticks 40, in the transition between conveyor 14 and wrapping tray 50, to remain in the same general direction. This may be preferable in some manufacturing operations, and indeed, may even be essential. In all respects, the action of reversing turret 116 and its cooperation with an associated vacuum chamber 122 and associated stationary cam 124 and comparable stick holders 126 is the same as disclosed for comparable structure of the present invention.

While the particular soft chewing gum wrapping machine as herein shown and disclosed in detail is fully capable of obtaining the objects and providing the advantages herein before stated, it is to be understood that it is merely illustrative of the presently preferred embodiment of the invention and that no limitations are intended to the details of construction or design herein shown other than as defined in the appended claims.

I claim:

1. A gum wrapping machine which comprises:

a wrapping tray formed with a plurality of nests having flat bottoms;

a rotable turret;

a chamber operatively associated with said turret;

means for creating a partial vacuum in said chamber;

means formed on said turret for cutting the gum into relatively thin rectangular shaped pieces having opposite flat sides with edges therebetween;

means associated with said turret for holding said shaped pieces thereon during transport of said pieces to a wrapping position, said holding means having a base formed with a recess and said base having a stem extending therefrom, said stem being formed with an air channel therethrough and having a suction port and a relief port associated therewith to establish fluid communication between said suction port, said relief port and said recess, said holding means being slidably mounted on said turret for reciprocal motion between a first position wherein said suction port is in fluid communication with said vacuum chamber and said relief port is blocked to establish a suction at said recess for holding said piece of gum thereon, and a second position wherein said suction port is blocked and a fluid communication is established between said relief port and the ambient air to relieve the suction at said recess to release said piece of gum from said holding means, and a cam mounted in said vacuum chamber to urge against said holding means for moving said holding means between said first position and said second position; and means on said turret for individually placing said pieces, one at a time, at said wrapping position into a respective nest with a side of said piece against said bottom of said nest.

2. A gum wrapping machine as cited in claim 1 further comprising:

a roll of wrapping material; and means to deposit a sized portion of said wrapping material over said nest prior to placement of said pieces into said nest.

3. A gum wrapping machine as cited in claim 2 further comprising ejector means to lift and remove said piece from said nest.

4. A gum wrapping machine as cited in claim 3 further comprising a magazine operatively associated with said wrapping tray for holding said pieces upon removal of said pieces from said wrapping tray.

5. A gum wrapping machine which comprises:

a wrapping tray formed with a plurality of nests having flat bottoms;

a turret;

means formed on said turret for cutting the gum into relatively thin rectangular shaped pieces having opposite flat sides with edges therebetween;

a reversing turret;

means associated with said turret for holding said shaped pieces thereon during transport of said pieces to said reversing turret;

means associated with said reversing turret for holding said shaped pieces thereon during transport of said pieces from said turret to said wrapping tray; and means on said reversing turret for individually placing said pieces into a respective nest with a side of said piece against said bottom of said nest.

6. A gum wrapping machine as cited in claim 5 which further comprises:

a first chamber operatively associated with said turret;

means for creating a partial vacuum in said first chamber;

a second chamber operatively associated with said reversing turret; and means for creating a partial vacuum in said second chamber.

7. A gum wrapping machine as cited in claim 6 wherein said holding means on said turret and said holding means on said reversing turret each have a base formed with a recess and said base has a stem extending therefrom, said stem being formed with an channel therethrough having a suction port and a relief port associated therewith to establish fluid communication between said suction port, said relief port and said recess.

8. A gum wrapping machine as cited in claim 7 wherein said holding means are slidably mounted on said respective turrets for reciprocal motion between a first position wherein said suction port is in fluid communication with said vacuum chamber and said relief port is blocked to establish a suction at said recess for holding said piece of gum thereon, and a second position wherein said suction port is blocked and fluid communication is established between said relief port and the ambient air to relieve the suction at said recess to release said piece of gum from said holding means.

9. A gum wrapping machine as cited in claim 8 further comprising a cam mounted in said chamber of said turret to urge against said holding means associated with said turret to move said holding means between said first position and said second position.

10. A gum wrapping machine as cited in claim 9 further comprising a cam mounted in said chamber of said reversing turret to urge against said holding means of said reversing turret to move said holding means between said first position and said second position.

11. A gum wrapping machine as cited in claim 10 further comprising:

a roll of wrapping material; and means to deposit a sized portion of said wrapping material over said nest prior to placement of said pieces into said nest.

12. A gum wrapping machine as cited in claim 11 further comprising ejector means to lift and remove said piece from said nest.

13. A gum wrapping machine as cited in claim 12 further comprising a magazine operatively associated with said wrapping tray for holding said pieces upon removal of said pieces from said wrapping tray.

14. A method for wrapping soft chewing gum comprising the steps of:

(a) Cutting said gum into relatively thin rectangular shaped pieces having opposite flat sides with edges therebetween;

(b) Transporting said gum to a wrapping position;

(c) Positioning a wrapper over a nest having a flat bottom;

(d) Urging said shaped piece into said nest at said wrapping position with one of said flat sides placed against said flat bottom to locate a portion of said wrapper therebetween;

(e) Folding said wrapper around said shaped piece of gum; and (f) Wherein said shaped pieces are transported to a wrapping position one at a time and wherein the transporting means and said nests move within the same vertical plane.

* * * * *